US007163716B2

(12) United States Patent
Aschenbeck

(10) Patent No.: US 7,163,716 B2
(45) Date of Patent: Jan. 16, 2007

(54) METHOD OF DEPOSITING GRANULES ONTO A MOVING SUBSTRATE

(75) Inventor: David P. Aschenbeck, Newark, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 211 days.

(21) Appl. No.: 10/647,858

(22) Filed: Aug. 25, 2003

(65) Prior Publication Data

US 2004/0086638 A1 May 6, 2004

Related U.S. Application Data

(63) Continuation-in-part of application No. 09/944,968, filed on Aug. 31, 2001, now Pat. No. 6,610,147.

(51) Int. Cl.
*B05D 1/12* (2006.01)

(52) U.S. Cl. ..... 427/202; 427/186; 427/188

(58) Field of Classification Search ..... 427/8, 427/186–188, 202, 204, 205; 118/308, 705, 118/19, 13; 251/326; 222/566, 322, 333, 222/408, 409

See application file for complete search history.

(56) References Cited

U.S. PATENT DOCUMENTS

| | | | | |
|---|---|---|---|---|
| 1,295,609 | A | | 2/1919 | Schulze |
| 1,419,169 | A | | 6/1922 | Overbury |
| 2,728,685 | A | | 12/1955 | Muench |
| 2,905,569 | A | | 9/1959 | Zitke |
| 3,101,281 | A | * | 8/1963 | Bowen, III ..... 118/674 |
| 3,283,740 | A | | 11/1966 | Fredricksen |
| 3,367,306 | A | | 2/1968 | Lawes et al. |
| 3,403,817 | A | | 10/1968 | Morash |
| 3,570,557 | A | | 3/1971 | Molins |
| 3,730,397 | A | | 5/1973 | Magnus |
| 4,478,869 | A | | 10/1984 | Brady et al. |
| 4,795,301 | A | | 1/1989 | Snead et al. |
| 4,800,102 | A | | 1/1989 | Takada |
| 4,900,589 | A | | 2/1990 | Montgomery |
| 5,024,356 | A | | 6/1991 | Gerling et al. |
| 5,072,687 | A | | 12/1991 | Mitchell et al. |
| 5,101,759 | A | | 4/1992 | Hefele |
| 5,183,507 | A | | 2/1993 | Scherer |
| 5,223,202 | A | | 6/1993 | Hall |
| 5,380,552 | A | | 1/1995 | George et al. |

(Continued)

OTHER PUBLICATIONS

Manual of Petroleum Measurement Standards—CH-15, AP1 Publication 2564, Dec. 1980.*

(Continued)

*Primary Examiner*—Fred J. Parker
(74) *Attorney, Agent, or Firm*—Inger H. Eckert; James J. Dottavio

(57) ABSTRACT

A method for depositing granules (48) onto a substrate (14) comprises providing a hopper (36) for granules with a discharge slot (46), moving a gate (50) across the slot to open and close the slot so that when the slot is open granules fall from the hopper and when the slot is closed granules are prevented from falling from the hopper, and detecting the speed of the substrate and controlling the extent of opening of the slot by the gate to meter the granules falling from the hopper in response to the speed of the substrate.

36 Claims, 5 Drawing Sheets

U.S. PATENT DOCUMENTS

| | | | | |
|---|---|---|---|---|
| 5,382,291 | A | 1/1995 | Olioso | |
| 5,417,165 | A | 5/1995 | Peppin et al. | |
| 5,437,318 | A | 8/1995 | Kanzler et al. | |
| 5,547,707 | A | 8/1996 | Haubert et al. | |
| 5,814,369 | A | 9/1998 | Bockh et al. | |
| 5,858,095 | A | 1/1999 | White et al. | |
| 5,997,644 | A | 12/1999 | Zickell | |
| 6,095,082 | A | 8/2000 | Belt et al. | |
| 6,228,422 | B1 | 5/2001 | White et al. | |
| 6,360,638 | B1 * | 3/2002 | White et al. | 83/13 |

OTHER PUBLICATIONS www.glenbrook.u12-il.us/gbssci/phys/class/IDKin/UIL56.html website (undated).*

* cited by examiner

METHOD OF DEPOSITING GRANULES ONTO A MOVING SUBSTRATE

RELATED APPLICATIONS

This application is a continuation-in-part application of U.S. patent application, Ser. No. 09/944,968, filed on Aug. 31, 2001 entitled, "Shingle Granule Valve And Method Of Depositing Granules Onto A Moving Substrate" now U.S. Pat. No. 6,610,147 issued Aug. 26, 2003.

TECHNICAL FIELD

This invention relates to methods and apparatus for depositing granules onto a moving substrate. More particularly, this invention relates to methods and apparatus for controlling the flow of granules from a blend drop granule dispenser that supplies granules to be deposited onto the moving substrate.

BACKGROUND OF THE INVENTION

A common method for the manufacture of asphalt shingles is the production of a continuous strip of asphalt shingle material followed by a shingle cutting operation which cuts the material into individual shingles. In the production of asphalt strip material, either an organic felt or a glass fiber mat is passed through a coater containing liquid asphalt to form a tacky asphalt coated strip. Subsequently, the hot asphalt strip is passed beneath one or more granule applicators which apply the protective surface granules to portions of the asphalt strip material. Typically, the granules are dispensed from a hopper at a rate which can be controlled by making manual adjustments to the width of the discharge slot of the hopper. In the manufacture of colored shingles, two types of granules are employed. Headlap granules are granules of relatively low cost for portions of the shingle which are to be covered up. Colored granules or prime granules are of relatively higher cost and are applied to the portion of the shingle which will be exposed on the roof.

Not all of the granules applied to the hot, tacky, asphalt coated strip adhere to the strip, and, typically, the strip material is turned around a slate drum to invert the strip and cause the non-adhered granules to drop off. These non-adhered granules, which are known as backfall granules, are usually collected in a backfall hopper. The backfall granules are eventually recycled and discharged onto the sheet.

To provide a color pattern of pleasing appearance the colored shingles are provided in different colors, usually in the form of a background color and a series of granule deposits of different colors or different shades of the background color. These highlighted series of deposits, referred to as blend drops, are typically made by discharging granules from a series of blend drop granule dispensers. To produce the desired effect, the length and spacing of the blend drops must be accurate. The length and spacing of each blend drop on the sheet is dependent on the relative speed of the sheet and the length of time during which the blend drop granules are discharged.

A uniform distribution of blend drop granules on the sheet is also desired. A uniform distribution produces a sharp distinction between the blend drop and the background areas, and this provides a more pleasing appearance to the shingle. Also, a uniform distribution enables the blend drop to be applied with a minimum of excess granules, thereby reducing the amount of wasted prime granules that must be downgraded for use in the headlap area of the shingle. To produce a uniform distribution, a constant flow rate of granules during the discharge from the blend drop dispenser is desired.

One method of applying granules to the moving sheet involves discharging the granules from hoppers using a fluted roll at the hopper discharge slot. The fluted roll is rotated to discharge the blend drop granules onto the asphalt sheet. The roll is ordinarily driven by a drive motor, the roll being positioned in the drive or non-drive position by means of a brake-clutch mechanism. This mechanical action required to discharge the blend drop granules with a fluted roll is burdened with inherent limitations. The distribution of the granules from the fluted roll is very non-uniform, resulting in a general inability to provide sharp lines at the leading edge and trailing edge of the blend drops. Further, the duration of each granule discharge is too long to produce a short blend drop deposit on a sheet traveling at high machine speeds. Also, the discharge of blend drop granules cannot achieve a constant flow rate quickly enough to produce a uniform granule deposit. Consequently, there is a limit to the sharpness of the blend drops on the shingle using a fluted roll.

Another method of applying granules to the moving sheet involves discharging granules from a discharge slot in a linear nozzle, as disclosed in U.S. Pat. No. 5,746,830 to Burton et al., which is incorporated herein by reference in its entirety. The granules are fed to the nozzle from a hopper. The discharge of granules from the linear nozzle is controlled by regulating the atmospheric pressure above the accumulation of granules in the nozzle. Increased or positive pressure above the granules in the nozzle causes the granules to flow through the discharge slot, and a negative pressure causes the granules to clog the discharge slot, thereby stopping the flow of granules through the slot.

U.S. Pat. No. 6,228,422 to White et al., which is incorporated herein by reference it its entirety, discloses a granule discharging apparatus in which the flow of granules from a hopper discharge slot is regulated by a slide gate that is arranged to be reciprocated linearly to open and close the discharge slot. The slide gate is operated to change to discharge slot to full open condition every time there is a blend drop. Therefore, there is no mechanism to vary the flow to accommodate changes in the linespeed of the moving sheet.

Current shingle production typically requires the capability to run a line at high and low line speeds, since it is occasionally necessary to slow the line due to production problems or due to operational consideration. Accordingly, it is desirable to have the equipment produce a consistent look at varying line speeds, so the shingles have a consistent appearance regardless of the speed at which they are produced. However, prior systems and methods are incapable of providing adjustments which enable a consistent blend drop and shingle appearance at varying line speeds. Typically, these systems provide a longer blend drop at higher speeds, since the web is moving at higher speed. Additionally, these systems are unable to consistently create sharp blend drops at all speeds, and/or have longer tails and/or leading edges due to bounce, scatter, or limited control.

My copending application, Ser. No. 09/944,968, " now U.S. Pat. No. 6,610,147 issued Aug. 26, 2003, which is incorporated herein by reference in its entirety, describes an improved valve for depositing granules, which provides improved efficiency, precision and control over the deposition of granules.

It is desired to provide an improved method and controls for discharging blend drop granules onto the moving sheet to produce a deposit having a uniform distribution of granules. It is particularly desirable to provide a granule depositing system that is more responsive to changes in line speed of the asphalt coated sheet, particularly at the higher line speeds. Also, it would be helpful to have a granule depositing system with more accurate controls of the blend drops to provide increased granule efficiency and improved blend drop appearance. It would also be beneficial to have a blend drop granule dispenser that more accurately opens and closes the granule deposition mechanism in response to changes in line speed.

SUMMARY OF THE INVENTION

The above objects as well as other objects not specifically enumerated are achieved by a method for depositing granules onto a substrate, where the method includes logic and controls for depositing granules onto a moving sheet.

According to this invention there is also provided a method of depositing granules onto a moving substrate. The method includes providing a hopper for containing granules, where the hopper has a discharge slot. A gate is moved across the slot to open and close the slot. When the slot is open granules fall from the hopper, and when the slot is closed granules are prevented from falling from the hopper. The method further includes detecting the speed of the substrate, and controlling the extent of opening of the slot by the gate to meter the granules falling from the hopper in response to the speed of the substrate.

According to this invention there is also provided a method of depositing granules onto a moving substrate. The method includes providing a hopper for containing granules, where the hopper has a discharge slot, and moving a gate across the slot to open and close the slot. When the slot is open granules fall from the hopper, and when the slot is closed granules are prevented from falling from the hopper. The method includes controlling the speed of the movement of the gate, and independently controlling the extent of opening of the slot by the gate to meter the granules falling from the hopper.

According to this invention there is also provided a method of depositing granules onto a moving substrate. The method includes providing a hopper for containing granules, the hopper having a discharge slot, and moving a gate across the slot to open and close the slot. When the slot is open granules fall from the hopper, and when the slot is closed granules are prevented from falling from the hopper. The method further includes controlling the acceleration rate of the gate during the opening of the slot so that the acceleration rate does not exceed about 4 g, where g is the acceleration of gravity.

According to this invention there is also provided a method of depositing granules onto a moving substrate. The method includes providing a hopper for containing granules, the hopper having a discharge slot, and moving a gate across the slot to open and close the slot. When the slot is open granules fall from the hopper, and when the slot is closed granules are prevented from falling from the hopper. The method further includes controlling the acceleration of the gate during the opening of the slot so that the acceleration rate is positive during a first portion of the opening of the slot, and the acceleration rate is approximately zero during a second portion of the opening of the slot.

According to this invention there is also provided a method of depositing granules onto a moving substrate. The method includes providing a hopper for containing granules, the hopper having a discharge slot, and moving a gate across the slot to open and close the slot. When the slot is open granules fall from the hopper, and when the slot is closed granules are prevented from falling from the hopper. The method further includes controlling the velocity of the gate during the closing of the slot so that the velocity does not exceed about 130 ft./min (39.624 m./min).

Various objects and advantages of this invention will become apparent to those skilled in the art from the following detailed description of the preferred embodiments, when read in light of the accompanying drawings.

DETAILED DESCRIPTION OF THE INVENTION

Figure 1:
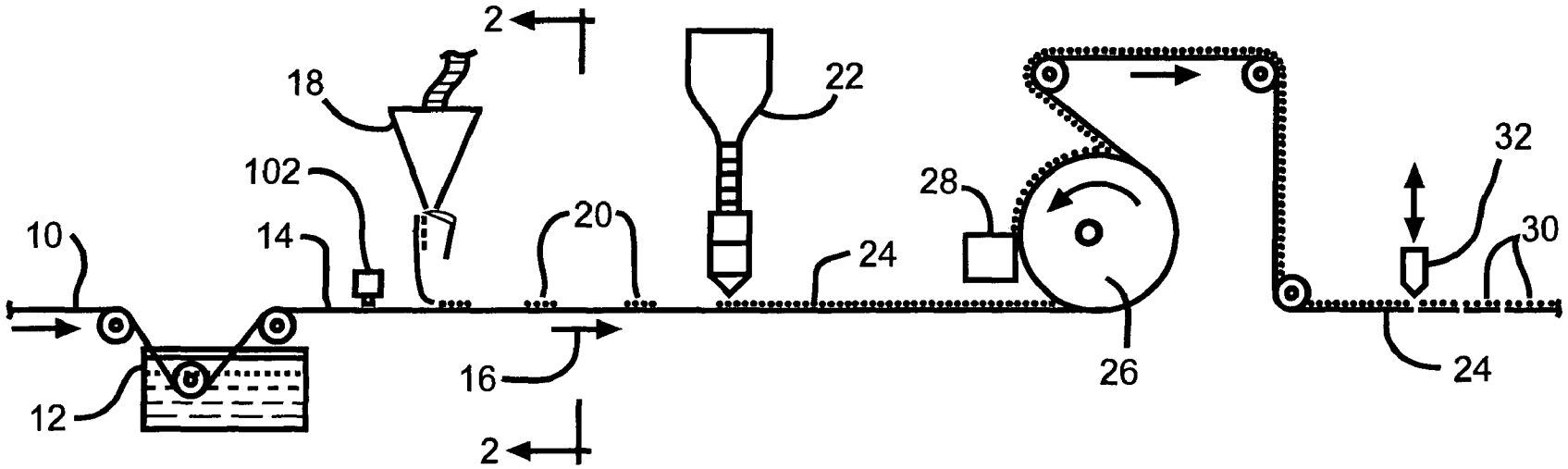
FIG. 1 is a schematic elevational view of a shingle manufacturing operation according to the invention.

As shown in FIG. 1, the shingle base mat 10, preferably a fiberglass mat, is passed through an asphalt coater 12 to form an asphalt coated sheet 14. The asphalt coated sheet 14 moves in the machine direction, indicated by arrow 16. Blend drop granule dispensers 18, only one of which is shown, are positioned above the asphalt coated sheet. These blend drop dispensers 18 are designed to apply blend drops 20 onto the asphalt coated sheet 14. Different ones of the plurality of blend drop dispensers 18 can be arranged to apply blend drops 20 of different shapes and color blends. The use of multiple blend drop dispensers is well known in the art.

Subsequent to the application of the blend drops 20 by all the blend drop dispensers 18, the background granule dispenser 22 applies background granules to the asphalt coated sheet 14. The background granules adhere to the portions of the asphalt coated sheet that not are already covered by the blend drop granules, and the complete coating of granules forms a granule covered sheet 24. The granule covered sheet 24 is then turned around a slate drum 26 where excess granules drop off and are collected in a backfall hopper 28 for subsequent reuse in the shingle making operation. After passing around the slate drum, the granule covered sheet 24 is cooled, cut into individual shingles 30 by a chopper 32, and packaged in bundles, not shown, for transportation to customers.

Figure 2:
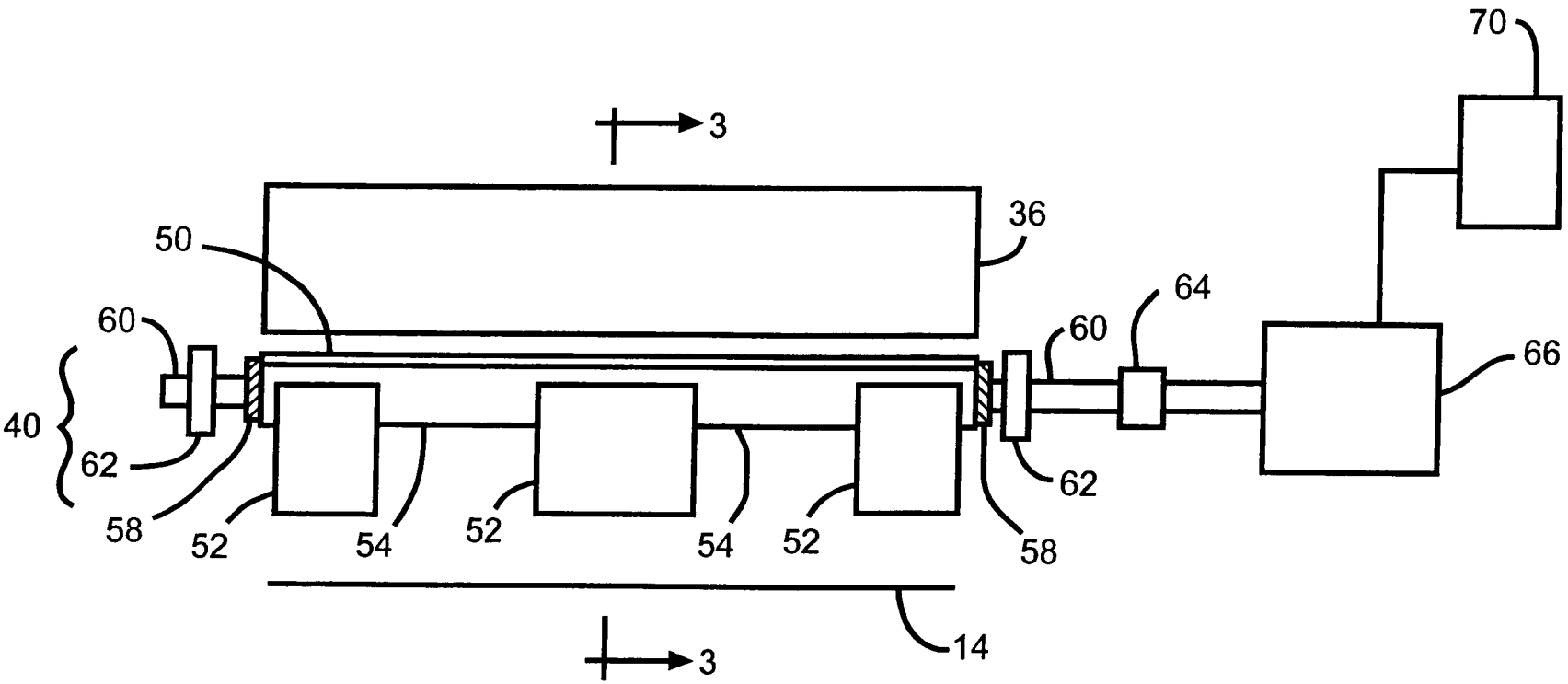
FIG. 2 is a schematic view in elevation of the granule applicator of the invention, taken along line 2—2 of FIG. 1.
Figure 3:
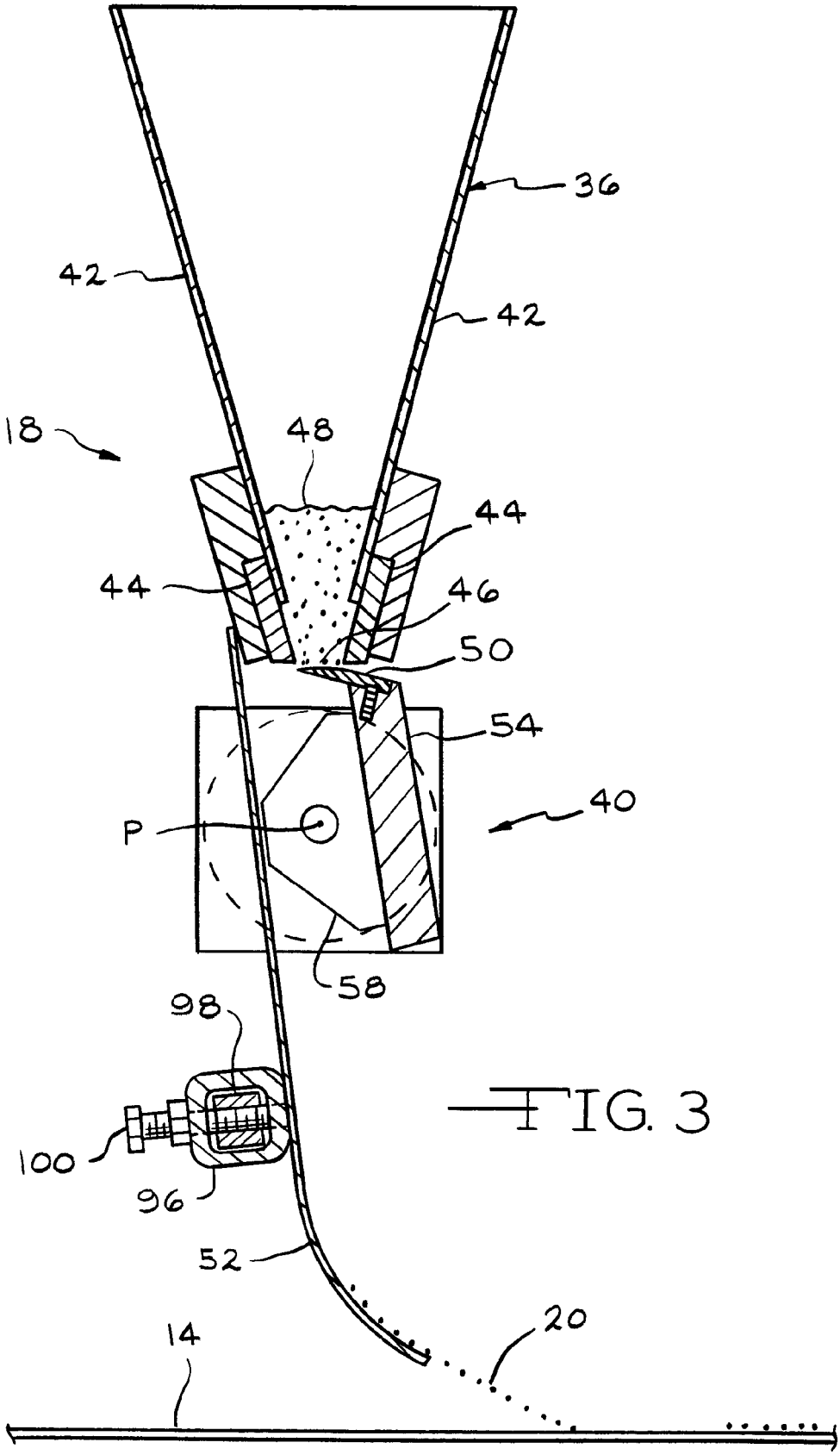
FIG. 3 is a cross-sectional view in elevation of the granule applicator of the invention, taken along line 3—3 of FIG. 2.

As shown in FIGS. 2 and 3, the blend drop dispensers 18 are generally comprised of a hopper 36 and a mechanism, generally indicated at 40 for metering and delivering granules from the hopper 36 onto the asphalt coated sheet 14 to form the blend drops 20. While a preferred drop dispenser 18 is described herein in detail, the principles are applicable to almost any known dispenser mechanism, such as a fluted roll or slide gate, or other such mechanism.

In the illustrated dispenser 18, the hopper 36 is generally comprised of converging walls 42, and optionally can be provided with wear plates 44 that can be replaced when desired. Granules 48 are fed to the hopper from granule supplies, not shown. The discharge slot 46 is the gap or space between the lowermost edges of the wear plates 44. In the event that the wear plates are not used, the discharge slot will be defined by the lowermost edges of the hopper walls 42. Optionally, the walls 42 and/or the wear plates 44 can be provided with an adjustability feature to enable changes in the size or shape of the discharge slot 46. The hopper 36 extends transversely across the moving asphalt coated sheet 14, and the discharge slot 46 is generally linear across the width of the shingle machine or portions of the shingle machine. It is to be understood that some shingle machines will be set up to make multiple shingles simultaneously, and blend drops are not needed in the headlap areas of the shingles. Therefore, although the discharge slot is typically continuous extending transverse to the machine direction, i.e., across the asphalt coated sheet, the hopper 36 is provided with dividers, not shown, that act to allow delivery of the granules the desired transverse sections of the slot 46.

The mechanism 40 for metering and delivering granules to form the blend drops 20 includes a movable gate 50 for opening and closing the discharge slot 46 of the hopper 36, and a chute 52 for directing the blend drops 20 onto the asphalt coated sheet 14. The gate 50 acts as a valve for dispensing the granules from the hopper 36. Preferably, the gate 50 is made of a hard material, such as steel. The gate 50 is mounted for reciprocal movement on a gate support member 54 in close proximity to the discharge slot 46 of the hopper so that reciprocation of the gate opens and closes the discharge slot to meter the granules 48 from the hopper 36. The spacing between the gate and the bottom of the adjustable plates 44 is approximately ⅛ inches (0.3175 cm). The gate support member 54 is preferably a generally flat bar, and is mounted for rotation about a pivot point P. The gate support member can be any structural member suitable for mounting the gate 50 for reciprocal movement. Ideally, the gate support member is oriented generally vertically so that it will not interfere with the blend drop granules falling from the hopper. Preferably, the gate support member 54 is made of a strong but light weight material, such as aluminum.

The rotation of the gate support member 54 causes the gate 50 to travel through an arc, about pivot point P. Since the discharge slot 46 is typically less than an inch in width, the arc necessary for travel of the gate to open and close the discharge slot 46 is less than about 30 degrees, and preferably less than about 20 degrees. In a typical construction, the width W of the discharge slot is about 0.65 inches (1.651 cm), and the reciprocal movement of the gate is about 0.75 inches (1.905 cm). While the reciprocal movement of the gate has been shown to be movement along an arc, it is to be understood that the reciprocal movement can be in a plane, i.e., linear. Further, while the arcuate movement of the gate 50 shown in the drawings is a reciprocal movement, it is to be understood that a plurality of gates, not shown, could be used to pass across the slot 46 seriatim to open and close the slot to create blend drops. In such an arrangement, the plurality of gates could be in the form of a wheel, not shown, having the gates at its circumference, or the gates could be in the form of a conveyor belt, not shown, containing the plurality of gates and positioned to pass directly beneath the discharge slot.

Figure 4:
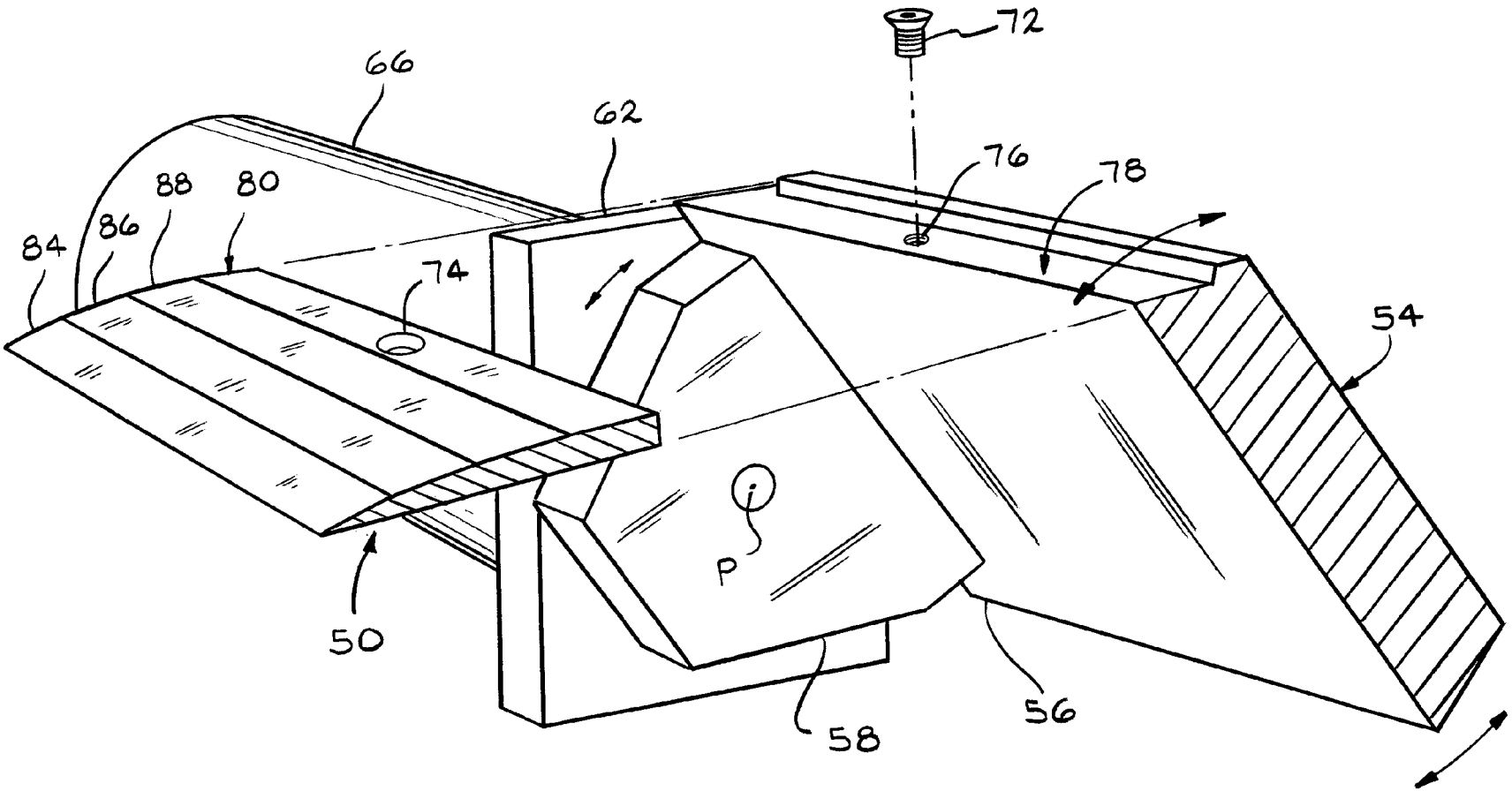
FIG. 4 is a perspective view of the framework for mounting the gate supports of the granule applicator.

As shown in FIGS. 3 and 4, the gate support member 54 is attached at its ends 56 to a pair of rotatably mounted mounting blocks 58, only one of which is shown in FIG. 4. The mounting blocks 58 are mounted on shafts 60 coincident with pivot point P, and the shafts 60 are mounted in bearings 62 for rotation about pivot point P. One of the shafts is connected through a coupler 64 to a motor 66, which preferably is a servo motor. A controller 70 is connected to the servo motor to control its operation. Although the gate is illustrated as being reciprocated through an arcuate path with a servo motor 66, it is to be understood that any suitable means for reciprocating the gate to open and close the discharge slot 46 can be used. For example, the gate could be reciprocated with a linear servo motor, a linear actuator or a cam/linkage mechanism. An important advantage of the servo motor and connections shown in the drawings is that rotary indirect movement or play associated with prior art rotational devices is nearly eliminated. The connection to the motor 66 is practically direct, and unintended rotational freedom of movement is limited to a single precision rotary coupling 62 and the rotary flex in the shafts 60. Further, the light weight nature of the gate support member 54 and the gate 50 minimizes inertia, thereby enabling faster and more precise movement of the gate.

Figure 5:
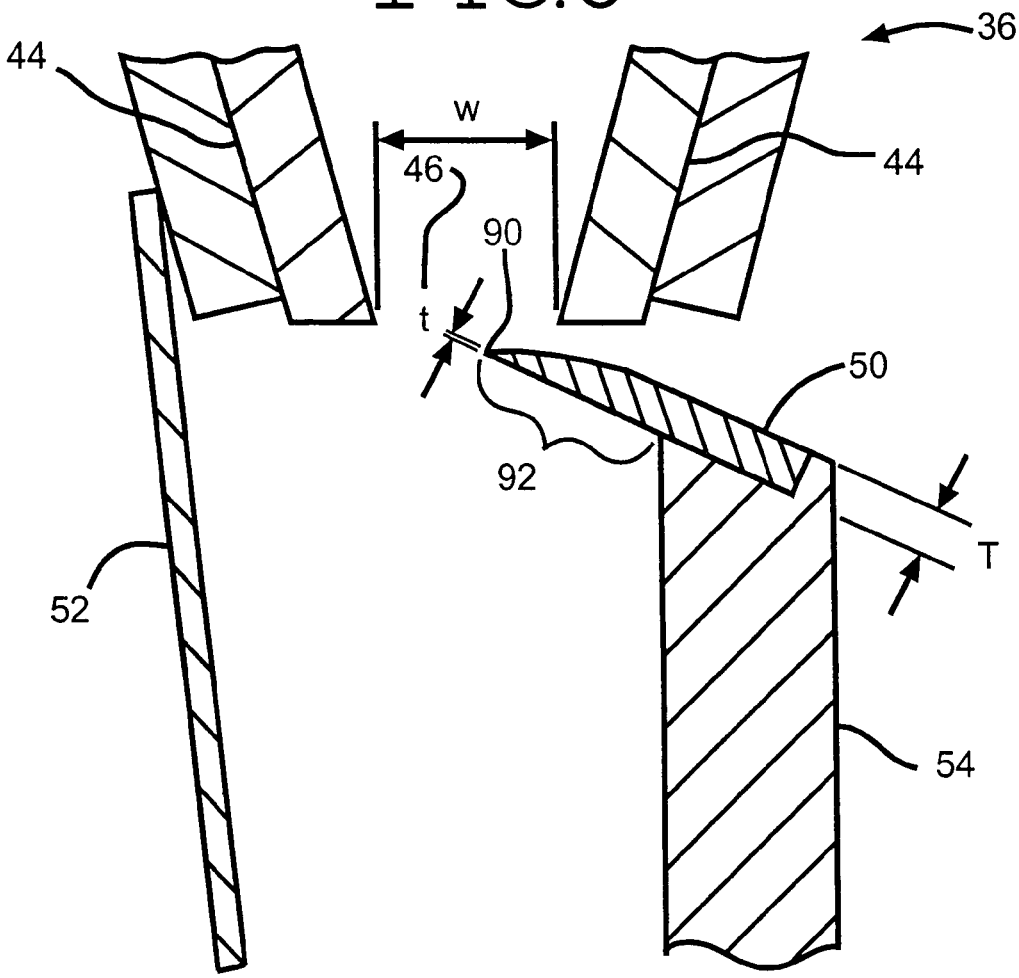
FIG. 5 is a view in elevation of the gate and hopper of the invention, with the slot partially open.

FIGS. 3–5 illustrate that the gate 50 is mounted on the gate support member 54 by means of threaded fasteners, such as screw 72. Other types of mounting for the gate can be used. The gate 50 has a screw aperture 74, and there is a threaded aperture 76 in the edge 78 of the gate support member 54 to allow the screw to hold the gate 50 firmly in place on the support member 54. A preferred shape for the top surface 80 of the gate 50 is a curved surface. For ease of manufacturing, a curved surface can be approximated by using a number of planar surfaces extending transverse to the machine direction, such as planar surfaces 84, 86 and 88. Any number of planar surfaces can be used to approximate a curved surface. The three planar surfaces 84, 86 and 88 are at acute angles to each other, forming a substantially curved upper surface.

As shown in FIG. 5, the cross-sectional shape of the gate 50 is elongated, with a leading edge 90 and a shank portion 92. It is preferred that the leading edge 90 be relatively thin to minimize the scattering of the blend drop granules as the gate rotates or reciprocates to close the discharge slot 46. The scattered granules are intercepted by the chute 52. Preferably, the thickness t of the leading edge 90 is within the range of from about 0.2 to about 1.5 times the median diameter of the granules. Typical prime granules have a size distribution allowing approximately 95 percent of the granules to pass through a U.S. No. 12 sieve, which has orifices having a diameter on the order of 65 mils. Further, typical prime granules have a size distribution allowing approximately 42 percent of the granules to pass through a U.S. No. 16 sieve, which has orifices having a diameter on the order of about 46 mils. From this, an assumption can be made that the prime granules have a median diameter of about 50 mils. Therefore, as best shown in FIGS. 3 and 5, the thickness t of the leading edge 90 is within the range of from about 10 mils to about 75 mils. More preferably, the thickness of leading edge 90 is less than about 50 mils, and most preferably less than about 20 mils.

The shank portion 92 of the gate extends back from the leading edge 90 of the gate for a distance that is as great as, or nearly as great as the width W of the discharge slot 46. Further, the thickness T of the shank portion 92 is preferably less than about 400 mils. The purpose of such a thin and elongated gate structure is that the gate must not bump into or interfere with the uppermost granules in a vertically oriented, falling blend drop when the gate is in the process of moving across the discharge slot to close off the flow of granules. Even more preferably, the thickness T of the shank portion 92 is less than about 200 mils.

In operation, the hopper 36 of the blend drop dispenser 18 is supplied with a supply of granules 48. The discharge slot 46 is kept closed by the gate 50, thereby preventing the granules from being discharged. The asphalt coated sheet 14 is being driven beneath the blend drop dispensers 18. When a blend drop is to be deposited onto the asphalt coated sheet, the controller 70 causes the servo motor to rotate, thereby rotating the gate 50 to open the discharge slot. With the discharge slot open, the granules fall downwardly. When the flow of granules is to be stopped, the controller signals the servo motor 66 to rotate the gate 50 back across the discharge slot 46 to close it.

As the gate closes the discharge slot 46, the leading edge 90 of the gate 50 will strike some of the granules, knocking them sideways into the chute 52. These granules will slide down the chute and remain a part of the blend drop. The chute may be provided with side walls, not shown, to maintain the granules in the proper lane. Further, as shown in FIG. 3 the chute 52 may be mounted using a steel channel 96 that extends transversely across the shingle machine, and is mounted on a stationary inner channel 98. The channel 96 may be provided with clamps 100 to fix the position of the chute after the chute is given the desired transverse position.

The use of the controller 70 and a means, such as the servo motor 66, for reciprocating the gate 50, allows several beneficial operating features according to the invention. The use of a servo motor enables the controller to detect the exact position of the gate at all times, and therefore the controller can precisely control the exact position of the gate with respect to the discharge slot. The controller can be programmed to operate the gate for opening the discharge slot to an extent less than completely open. For example, the controller can provide for opening the slot to a half open position. This would allow granules to be discharged at approximately half the maximum possible rate. This method enables the granules from the hopper to be metered out in a controlled fashion, as dictated by the controller 70. This ability to move the gate to the extent necessary to achieve a selected percentage of the slot being opened allows great flexibility in operating the shingle machine. A practical application of this feature is that when the speed of the substrate or asphalt coated sheet 14 is known, such as by the use of a line speed detector 102, as shown in FIG. 1, the extent of opening of the slot by the gate can be controlled to meter the granules falling from the hopper in response to the speed of the substrate.

Line speed detectors are well known in the art. Accordingly, as the line speed increases, the controller will operate the gate so that it will open the slot to a more open position. It is desirable to have a relatively constant flow rate of granules, providing a drop density within the range of from about 1.0 to about 1.6 grams of granules per square inch of substrate, regardless of the speed of the substrate. Typically, the sheet has a granule density of about 1.0 grams per sq. inch, or only about 1.0 gram of granules remains on a square inch of the asphalt coated sheet after complete processing. It is also important to control the length of the blend drop on the coated web at all line speeds, so that the shingles look similar regardless of line speed, and therefore the present invention's ability to control the speed and duration of the opening (and resulting length of the blend drop), results in the ability to produce a consistent appearance at all line speeds. The appearance should not be discernible from a distance of over five feet, or at least not discernible from a rooftop.

Preferably, the controller includes an algorithm which adjusts the gate opening and gate speeds to keep on-sheet deposition constant, or at least consistently about 1.0 to 1.6 grams per inch, with a consistent leading and trailing edge, and a consistent length on the sheet. Preferably, the algorithm is capable of controlling the drop at all line speeds to produce a consistent appearance, but should be able to do so at speeds of as low as about 200 feet/minute, while also being able to provide a substantially similar blend drop when the line speed increases to a high speed of about 750 feet/minute or more, as well as any speed therebetween, so that the appearance of two shingles produced at such dissimilar line speeds have consistent appearance in the blend drop intensity, length and leading and trailing edges. Such capability should have infinite adjustment capabilities throughout the operating speed of the system (or at minimum, operate at a large number of speeds therebetween). Preferably, such a system can operate at slower and faster speeds, preferably 1000 ft/minute or more.

Additionally, the leading and trailing edges should have approximately the same appearance, such that these the edges should be indistinguishable to an observer. Specifically, the transition from the blend drop to background and vice-versa should have a length of about the same dimension. Preferably the length of this transition at high speed and low speed should be within about 15 percent, more preferably within about ten percent, and even more preferably within five percent or less. Likewise the length of the drop should be approximately the same, at most the drops at high speed and low speed should be within about 15 percent, more preferably within about ten percent, and even more preferably within five percent or less.

Another feature of the invention pertains to the ability of the controller to control the velocity and/or acceleration rate of the gate 50 during the opening and closing of the discharge slot 46. In general, as the line speed of the asphalt coated sheet 14 increases, the acceleration rate of the gate 50 during opening and closing of the discharge slot must be increased to maintain a sharp-edged blend drop on the asphalt coated sheet. However, there are instances where it is desirable to control the velocity and/or acceleration rate of the gate 50. For example, where a blend drop having a feathering or smear of blend drop granules is required at a low line speed, the gate may be controlled to accelerate at a low rate, thereby mimicking the visual effect of the smear of granules at a high line speed.

There are reasons for limiting the acceleration rate of the gate. Acceleration of the gate during opening of the slot at too high a rate can cause an undesirable initial slug or excess amount of granules. Also, when the gate is closed, excessive acceleration rates for the gate will knock more of the granules into the contact with the chute 52, thereby disturbing the visual uniformity of the granules at the rear or tail of the blend drop. Finally, some blend drop patterns may require different velocities and acceleration rates for the gate. Although the acceleration and deceleration rates may be greater, it is preferred that the acceleration and deceleration rates be kept at a level lower than about 4 g, where a is the acceleration of gravity, and more preferably at less than about 3 g, and even more preferably at approximately 2 g. Also, preferably the velocity of the gate during the closing of the slot is controlled so that it does not exceed about 130 ft./min (39.624 cm). This minimizes the amount of granules that are scattered by the leading edge of the gate.

Figure 6:
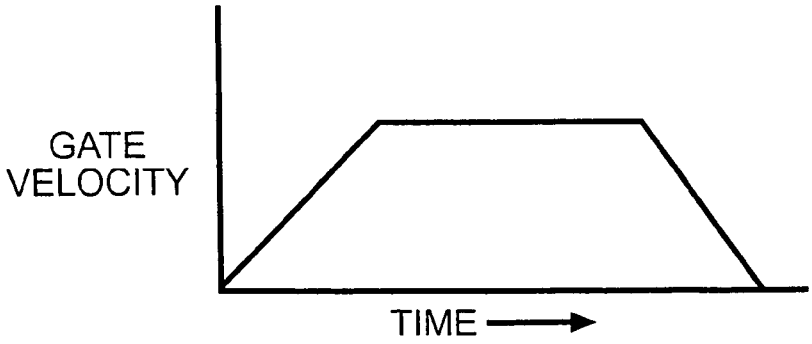
FIG. 6 is a graph of the velocity of the gate during the opening of the gate according to one embodiment of the invention.

A further aspect of the present invention is that the controller can be programmed to control the acceleration and velocity of the gate independently of the controlling of the extent of the opening of the slot by the gate. This independent control of the two functions, acceleration of the gate and degree of opening of the slot, provides great flexibility to the operators of the shingle machine. An example of how this could work is illustrated in FIG. 6. At time zero, the gate begins to accelerate at a constant rate. The gate velocity increases from zero to a desired level. Then the acceleration becomes zero and the gate is moving at a constant velocity, as evidenced by the flat part of the curve in FIG. 6. Finally, the gate decelerates so that it comes to rest, with a velocity of zero. Preferably, the acceleration drops to zero, i.e., the velocity levels off, when the velocity reaches a value that is within the range of from about 10 to about 190 ft./min (3.048 to about 57.912 m./min). During manufacturing of shingles having a need for relatively precise blend drops, such as laminated shingles with a slate or three-dimensional look, the leveling off velocity is at the high end of the range, such as greater than about 90 ft./min (27.432 m). For manufacturing shingles where a more muted blend drop is needed, such as classic three-tab shingles, the leveling off velocity is at the low end of the range, such as less than about 30 ft./min (9.144 m).

As indicated above, the principles of the current invention may be applied to other granule applicators, such as those indicated in the background section. For example, the slide gate described in White could be controlled in a similar manner, provided that appropriate enhancements we remade to the hardware and controls to provide the requisite capabilities of controlling the valve opening, position, and/or closing. Likewise, the device taught in Burton et al may be modified to change the way the pressurization is applied to the drop; in this regard the mechanical gate described herein comprises modifying the pressurization and pressurization rate in a manner similar to the control of the mechanical valve, and therefore for the purposes of this disclosure, the pressurization means of Burton may be considered to be a "gate" for opening and closing the discharge slot. Likewise, the fluted roll or other known devices may be similarly modified, to control the opening size, velocity, and acceleration, to achieve the controls taught herein.

The principle and mode of operation of this invention have been described in its preferred embodiments. However, it should be noted that this invention can be practiced otherwise than as specifically illustrated and described without departing from its scope.

What is claimed is:

1. A method of depositing granules onto a moving substrate comprising:

providing a hopper for containing granules, the hopper having a discharge slot;

moving a gate across the slot to open and close the slot, whereby when the slot is open granules fall from the hopper, and when the slot is closed granules are prevented from falling from the hopper;

detecting the speed of the substrate; and controlling metering of the granules falling from the hopper in response to the speed of the substrate by independently controlling: i) the speed of the gate opening; and ii) the degree of opening of the slot by the gate to meter the granules falling from the hopper in a controlled fashion.

2. The method according to claim 1, wherein the valve comprises one of a rotary valve, a slide valve, a fluted roll and a pneumatic valve.

3. The method according to claim 2, wherein the valve comprises a rotary valve.

4. A method of depositing granules onto a moving substrate comprising:

providing a hopper for containing granules, the hopper having a discharge slot;

moving a gate across the slot to open and close the slot, whereby when the slot is open granules fall from the hopper, and when the slot is closed granules are prevented from falling from the hopper;

controlling the speed of the movement of the gate; and independently controlling the degree of opening of the slot by the gate to meter the granules falling from the hopper in a controlled fashion.

5. The method of claim 4 in which the controlling opening of the slot is done in response to the speed of the substrate.

6. A method of depositing granules onto a moving substrate comprising:

providing a hopper for containing granules, the hopper having a discharge slot;

moving a gate across the slot to open and close the slot whereby when the slot is open granules fall from the hopper, and when the slot is closed granules are prevented from falling from the hopper;

controlling the acceleration rate of the gate during the opening of the slot so that the acceleration rate does not exceed about 4 g (where g is the acceleration of gravity) and controlling the speed of the movement of the gate; and independently controlling the degree of opening of the slot by the gate to meter the granules falling from the hopper in a controlled fashion.

7. The method of claim 6 in which the maximum acceleration rate of the gate during the opening of the slot is about 3 g.

8. The method of claim 6 in which the maximum acceleration rate of the gate during the opening of the slot is about 2 g.

9. The method of claim 6 in which the controlling of the degree of opening of the slot is done in response to the speed of the substrate.

10. A method of depositing granules onto a moving substrate comprising:

providing a hopper for containing granules, the hopper having a discharge slot;

moving a gate across the slot to open and close the slot, whereby when the slot is open granules fall from the hopper, and when the slot is closed granules are prevented from falling from the hopper;

controlling the acceleration of the gate during one of the opening of the slot and the closing of the slot, so that the acceleration rate is positive during a first portion of the one of the opening and closing of the slot, and the acceleration rate is approximately zero during a second portion of the one of the opening and closing of the slot; and independently controlling the degree of opening of the slot by the gate to meter the granules falling from the hopper in a controlled fashion.

11. The method of claim 10 including controlling the acceleration rate of the gate during the one of the opening and closing of the slot so that the acceleration rate does not exceed about 4 g.

12. The method of claim 11 in which the maximum acceleration rate of the gate during the one of the opening and closing of the slot does not exceed about 3 g.

13. The method of claim 12 in which the maximum acceleration rate of the gate during the one of the opening and closing of the slot does not exceed about 2 g.

14. The method of claim 11 in which the velocity of the gate during the second portion of the one of the opening and closing of the slot is within the range of from about 10 to about 130 ft/min.

15. The method of claim 14 which the velocity of the gate during the second portion of the one of the opening and closing of the slot is greater than about 90 ft/min.

16. The method of claim 14 which the velocity of the gate during the second portion of the one of the opening and closing of the slot is less than about 30 ft/min.

17. A method of depositing granules onto a moving substrate comprising:

providing a hopper for containing granules, the hopper having a discharge slot;

moving a gate across the slot to open and close the slot, whereby when the slot is open granules fall from the hopper, and when the slot is closed granules are prevented from falling from the hopper;

detecting the speed of the substrate; and controlling opening of the slot by the gate to meter the granules falling from the hopper in response to the speed of the substrate; the acceleration rate of the gate; and the speed of the movement of the gate and the extent of opening of the slot by the gate to meter the granules falling from the hopper; wherein the opening of the slot includes independently controlling: i) the speed of the movement of the gate, and ii) the degree of opening of the slot by the gate to meter the granules falling from the hopper in a controlled fashion.

18. The method of claim 17 in which the controlling of the degree of opening of the slot is done in response to the speed of the substrate.

19. The method according to claim 17, wherein the valve comprises one of a rotary valve, a slide valve, a fluted roll and a pneumatic valve.

20. The method according to claim 19, wherein the valve comprises a rotary valve.

21. The method according to claim 20, further comprising controlling the acceleration of the gate during the opening of the slot so that the acceleration rate is positive during a first portion of the opening of the slot, and the acceleration rate is approximately zero during a second portion of the opening of the slot.

22. The method of claim 21 including controlling the acceleration rate of the gate during the opening of the slot so that the acceleration rate does not exceed about 4 g.

23. The method of claim 22 in which the maximum acceleration rate of the gate during the opening of the slot is about 2 g.

24. The method of claim 23 in which the velocity of the gate during the second portion of the opening of the slot is within the range of from about 10 to about 130 ft/min.

25. The method of claim 24 which the velocity of the gate during the second portion of the opening of the slot is greater than about 90 ft./min.

26. The method of claim 24 which the velocity of the gate during the second portion of the opening of the slot is less than about 30 ft/min.

27. A method of depositing granules onto a moving substrate comprising:

providing a hopper for containing granules, the hopper having a discharge slot;

providing a means for starting and stopping flow from the slot, whereby when granules fall from the hopper and are prevented from falling from the hopper;

detecting the speed of the substrate; and independently controlling:

the degree of opening of the slot by the gate to meter the granules falling from the hopper in response to the speed of the substrate;

the acceleration rate at which the flow is started and stopped; and the speed of the movement of the means for starting and stopping flow gate and the degree of opening of the slot by the gate to meter the granules falling from the hopper in a controlled fashion.

28. The method of claim 27 wherein the step of controlling comprises controlling the degree of opening of the slot and independently controlling the speed of the movement of the gate and the degree of opening of the slot by the gate to meter the granules falling from the hopper.

29. The method of claim 28 wherein the step of controlling further comprises controlling the acceleration rate at which the flow is started and stopped.

30. The method according to claim 29, wherein the means for starting and stopping flow from the slot comprises a rotary valve.

31. The method according to claim 27, wherein the step of controlling further comprises producing a blend drop at a speed from about 200 ft/min. to about 1,000 ft/min.

32. The method according to claim 31, wherein the step of controlling further comprises producing a first blend drop at a first speed and a second blend drop at a second speed, wherein the first speed is slower than the second speed, and wherein said first blend drop and said second blend drop are substantially similar in appearance.

33. The method according to claim 32, wherein the step of controlling comprises producing a substantially constant blend drop density at said second speed and said first speed.

34. The method according to claim 33, wherein the blend drop density falling onto said coated sheet is between 1.0 and 1.6 grams/square inch at both said second speed and said first speed.

35. The method according to claim 32, wherein the step of controlling comprises producing a said first blend drop with a first length and said second blend drop with a second length, wherein said second length is substantially the same as the first length.

36. The method according to claim 32, wherein the step of controlling comprises producing a said first blend drop with a first leading edge and first trailing edge and said second blend drop with a second leading edge and second trailing edge, wherein said first and second leading edges are substantially the same and said first and second trailing edges are substantially the same.

* * * * *